US008483591B2

(12) United States Patent
Lin et al.

(10) Patent No.: US 8,483,591 B2
(45) Date of Patent: Jul. 9, 2013

(54) BIAS CHARGING OVERCOAT

(75) Inventors: Liang-Bih Lin, Rochester, NY (US); Gary A. Batt, Fairport, NY (US); Brian Gilmartin, Williamsville, NY (US); Jeanne M. Koval, Marion, NY (US); Aaron M. Stuckey, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 653 days.

(21) Appl. No.: 12/548,522

(22) Filed: Aug. 27, 2009

(65) Prior Publication Data

US 2011/0052252 A1 Mar. 3, 2011

(51) Int. Cl.
*G03G 15/00* (2006.01)

(52) U.S. Cl.
USPC ..... 399/109

(58) Field of Classification Search
USPC ..... 399/109, 176
See application file for complete search history.

(56) References Cited

U.S. PATENT DOCUMENTS

| | | | | |
|---|---|---|---|---|
| 4,899,689 | A | 2/1990 | Takeda et al. | |
| 5,017,965 | A | 5/1991 | Hashimoto et al. | |
| 5,068,063 | A * | 11/1991 | Tremper, III | 252/519.34 |
| 5,678,140 | A | 10/1997 | Fuei et al. | |
| 5,804,309 | A | 9/1998 | Itoh et al. | |
| 5,822,169 | A | 10/1998 | Yoshioka et al. | |
| 6,203,855 | B1 | 3/2001 | Tarnawskyj et al. | |
| 6,376,594 | B1 | 4/2002 | Sasagawa et al. | |
| 6,458,883 | B1 * | 10/2002 | Takashima et al. | 524/495 |
| 6,807,389 | B2 | 10/2004 | Facci et al. | |
| 6,889,023 | B2 | 5/2005 | Suda et al. | |
| 6,915,095 | B2 | 7/2005 | Longhenry et al. | |
| 6,962,746 | B2 | 11/2005 | Taniguchi et al. | |
| 2003/0113650 | A1 | 6/2003 | Suwabe et al. | |
| 2004/0057749 | A1 * | 3/2004 | Saito et al. | 399/109 |
| 2007/0224404 | A1 * | 9/2007 | Finley et al. | 428/220 |
| 2007/0230975 | A1 * | 10/2007 | Yamazaki et al. | 399/31 |
| 2007/0271792 | A1 | 11/2007 | Kagawa et al. | |
| 2009/0180806 | A1 | 7/2009 | Oshima et al. | |

FOREIGN PATENT DOCUMENTS

| | | | |
|---|---|---|---|
| EP | 0606907 | A1 | 7/1994 |
| JP | 2006163059 | A * | 6/2006 |

OTHER PUBLICATIONS

Translation of JP 2006163059 A, Jun. 2006.*
Machine translation of Naito (JP 2006163059 A) publication date Jun. 22, 2006.*
U.S. Appl. No. 12/622,684, filed Nov. 20, 2009, Office Action dated Nov. 20, 2009.
U.S. Appl. No. 12/622,684, filed Oct. 16, 2012, Final Office Action.
Wenderoth, U.S. Appl. No. 12/622,682, Office Action, 20090987-US-NP, Apr. 17, 2013, 32 pages.

* cited by examiner

*Primary Examiner* — Walter L Lindsay, Jr.
*Assistant Examiner* — Frederick Wenderoth
(74) *Attorney, Agent, or Firm* — Hoffman Warnick LLC

(57) ABSTRACT

There is described a bias charging member that includes a conductive core and an outer surface layer on the conductive core. The outer surface layer includes a resin of aminoplast and one of polyol or nylon, a conductive additive and p-toluene sulfonic acid. There is also described a method of refurbishing bias charging members.

10 Claims, 2 Drawing Sheets

BIAS CHARGING OVERCOAT

TECHNICAL FIELD

The disclosure herein relates to overcoat layers, and more specifically, to an outer surface layer of a resin of an aminoplast and one of a polyol or nylon, and a conductive additive for xerographic members such as bias charging members.

BACKGROUND

In a conventional charging step included in electrophotographic processes using an electrophotographic photosensitive member, in most cases a high voltage (DC voltage of about 5-8 KV) is applied to a metal wire to generate a corona, which is used for the charging. In this method, however, a corona discharge product such as ozone and $NO_x$ is generated along with the generation of the corona. Such a corona discharge product deteriorates the photosensitive member surface and may cause deterioration of image quality such as image blurring or fading or the presence of black streaks across the copy sheets. Further, ozone contamination may be harmful to humans if released in relatively large quantities. In addition, a photosensitive member that contains an organic photoconductive material is susceptible to deterioration by the corona products.

Also, as the power source, the current directed toward the photosensitive member is only about 5 to 30% thereof. Most of the power flows to the shielding plate. Thus, the efficiency of the charging means is low.

For overcoming or minimizing such drawbacks, methods of charging have been developed using a direct charging member for charging the photosensitive member. For example, U.S. Pat. No. 5,017,965 to Hashimoto et al, uses a charging member having a surface layer which comprises a polyurethane resin. Another approach, European Patent Application 0 606 907 A1, uses a charging roller having an elastic layer comprising epichlorohydrin rubber, and a surface layer thereover comprising a fluorine containing bridged copolymer.

These and other known charging members are used for contact charging a charge-receiving member (photoconductive member) through steps of applying a voltage to the charging member and disposing the charging member being in contact with the charge-receiving member. Such bias charging members require a resistivity of the outer layer within a desired range. Specifically, materials with resistivities which are too low will cause shorting and/or unacceptably high current flow to the photoconductor. Materials with too high resistivities will require unacceptably high voltages. Other problems which can result if the resistivity is not within the required range include nonconformance at the contact nip, poor toner releasing properties and generation of contaminant during charging. These adverse affects can also result in bias charging members having non-uniform resistivity across the length of the contact member. It is usually the situation that most of the charge is associated at or near the center of the charge member. The charge seems to decrease at points farther away from the center of the charge member. Other problems include resistivity that is susceptible to changes in temperature, relative humidity, running time, and leaching out of contamination to photoconductors.

Due to its contact, the direct charging apparatus also causes more wear and tear to itself, imaging members and any other components with which it comes in contact. Failure modes in a bias charge roller (BCR) show up in prints such as dark streaks, and white and dark spots, which are associated with surface damages on BCR. These defects are usually derived from degradation or debris build-up on the BCR surface along the circumference, i.e. the process direction. The degradations can be scratches, abrasion, or pothole-like damages to the BCR surface. Another known deficiency is toner filming on the BCR surface that can also show up as print streaks. All these failures will reduce BCR life and therefore limit usage life.

SUMMARY OF THE INVENTION

There is described a bias charging member including a conductive core and an outer surface layer provided on the conductive core. The outer surface includes a resin of aminoplast, a conductive additive and either a polyol or nylon.

There is further described a method for refurbishing a bias charging member that includes obtaining a bias charging member having a conductive core and an outer surface. A dispersion of an aminoplast resin, one of a polyol resin or a nylon resin, and a conductive additive is coated on the outer surface and cured to form a conductive overcoat.

There is further described a bias charging member that includes a conductive core and an outer surface layer provided on the conductive core. The outer surface layer includes a resin of melamine and one of polyol or nylon, carbon black and p-toluene sulfonic acid, and has a surface resistivity of from about $1\times10^{1}$ to about $1\times10^{12}$ ohm/.

DETAILED DESCRIPTION

Figure 1:
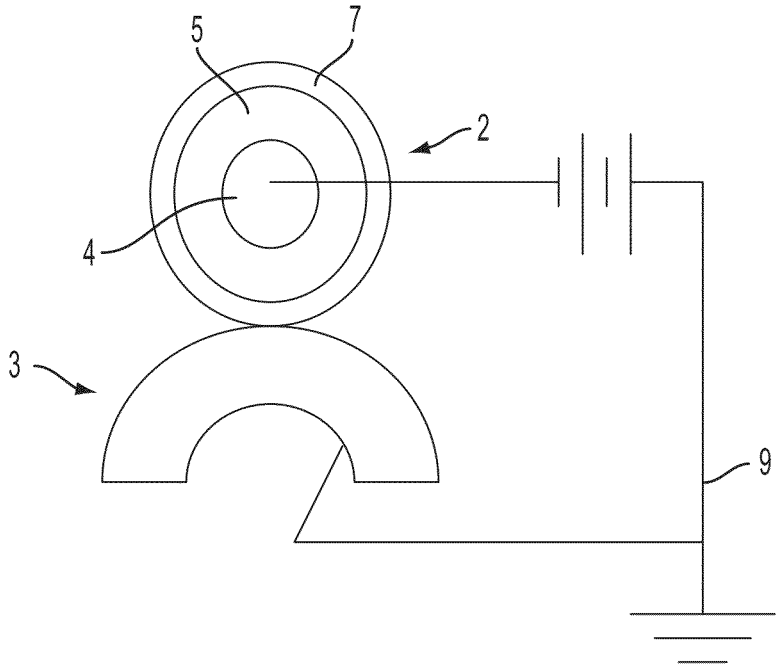
FIG. 1 demonstrates an illustrative bias charging roll (BCR) having an electrically conductive core and an outer surface layer provided thereon.

Referring to FIG. 1, there is shown an embodiment having a bias charging roller (BCR) 2 held in contact with an image carrier implemented as a photoconductive member 3. However, embodiments herein can be used for charging a dielectric receiver or other suitable member to be charged. The photoconductive member 3 may be a drum, a belt, a film, a drelt (a cross between a belt and a drum) or other known photoconductive member. While the BCR 2 is in rotation, a DC voltage and optional AC current is applied from a power source 9 to a electro-conductive core 4 of the BCR 2 to cause it to charge the photosensitive member 3. Shown in FIG. 1, the electro-conductive core 4 is surrounded by a base material 5. Although shown as one layer, it is possible to eliminate the base material 5 or have multiple layers of base material. These layers are referred to as base layers, intermediate layers or substrate layers. The base material 5 for the BCR 2 can be any elastic material with semiconductive dopant of suitable fillers discussed below. A semiconductive protective overcoat 7 is provided on the base material 5 of the BCR 2 to form the outer surface layer. There may or may not be a filler in the substrate layer, intermediate layer, and outer layer.

The semiconductive protective overcoat 7 is based on an aminoplast resin and one of a polyol resin or nylon. An aminoplast is thermosetting resin produced by the condensation polymerization of an amino group-containing compound with an aldehyde. The primary amines used are urea and melamine, and the sole aldehyde used commercially is formaldehyde. The names of resins made with these particular starting materials are either urea-formaldehyde resin or melamine-formaldehyde resin. The aminoplast resin is preferably melamine. When the aminoplast resin is combined with polyol, the weight ratio of aminoplast to polyol is about 5/95 to about 95/5 and from about 25/75 to about 75/25. When ratios between the polyol (AT-410 Rohm & Haas) and melamine (Cymel 323 by Cytec Corp) were varied from about 25/75 to 75/25, similar film forming properties were found for the ranges studied when coated on polyethylene terephthalate (PET) substrate. When the aminoplast resin is combined with nylon the weight ratio of aminoplast to nylon is about 95/5 to about 30/70 or from about 90/10 to about 50/50. When ratios between the melamine (Cymel 323 by Cytec Corp) and nylon (Elvamid 8061 by Dupont) were varied from about 95/5 to 30/70, similar film forming properties were found when coated on PET substrate. However, when coated on BCRs, higher nylon contents induce some wrinkles.

The bulk and surface conductivity of the protective overcoat 7 or outer surface layer should be higher than that of the BCR 2 to prevent electrical drain on the BCR 2, but only slightly more conductive. The inventors have found that, as long as a more conductive layer than the base material 5 is applied to BCR 2, good (time=0) charge uniformity and print quality can be obtained with proper thermoset resins. Overcoats 7 with from about $1\times10^{1}$ ohm/to about $1\times10^{12}$ ohm/, of from about $1\times10^{2}$ ohm/to about $1\times10^{8}$ ohm/, or from about $1\times10^{5}$ ohm/to about $1\times10^{6}$ ohm/surface resistivity were found to be advantageous.

The electro-conductive core 4 serves as an electrode and a supporting member of the charging roll, and is composed of an electro-conductive material such as a metal or alloy of aluminum, copper alloy, stainless steel or the like; iron coated with chromium or nickel plating; an electro-conductive resin and the like. The diameter of the electro-conductive support is, for example, about 1 mm to about 20 cm, or from about 5 mm to about 2 cm.

The base material can be isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber (EPDM), acrylonitrile-butadiene copolymer rubber (NBR), natural rubber, and blends thereof. Among these, polyurethane, silicone rubber, EPDM, epichlorohydrin-ethylene oxide copolymer rubber, epichlorohydrin-ethylene oxide-allyl glycidyl ether copolymer rubber, NBR, and blends thereof are preferably used. An electro-conductive agent, an electronic electro-conductive agent or an ionic electro-conductive agent may be used in the base material. Examples of the electronic electro-conductive agent include fine powder of: carbon black such as Ketjen Black and acetylene black; pyrolytic carbon, graphite; various kinds of electro-conductive metal or metal alloy such as aluminum, copper, nickel and stainless steel; various kinds of electro-conductive metal oxide such as tin oxide, indium oxide, titanium oxide, tin oxide-antimony oxide solid solution, and tin oxide-indium oxide solid solution; insulating materials having a surface treated by an electro-conductive process; and the like. Furthermore, examples of the ionic electro-conductive agent include perchlorates or chlorates of tetraethylammonium, lauryltrimethyl ammonium and the like; perchlorates or chlorates of alkali metal such as lithium and magnesium, and alkali earth metal; and the like. These electro-conductive agents may be used alone, or in combination of two or more kinds thereof.

Furthermore, the amount of addition to the base material is not particularly limited. However, the amount of the electronic electro-conductive agent to be added is from about 1 to about 30 parts by weight, or from about 5 to about 25 parts by weight with respect to 100 parts by weight of the rubber material. The amount of the ionic electro-conductive agent to be added is in the range of about 0.1 to about 5.0 parts by weight, or from about 0.5 to about 3.0 parts by weight with respect to 100 parts by weight of the rubber material.

The layer thickness of the base material is from about 10 mm to about 20 cm, or from about 50 mm to about 3 cm. The protective overcoat layer is composed of an aminoplast resin and one of a polyol resin or nylon and an electro-conductive agent, which can be any of the electro-conductive agents described for the base material. The amount of the electro-conductive agent to be added is not particularly limited, however in the range of about 0.1 to about 40 by weight, or from about 4 to about 9 parts by weight, or in the range of about 6 to 7 parts by weight with respect to 100 parts by weight of the total weight of the coating.

As for the particles, fine polymer of metal oxides and composite metal oxides of silicon oxide, aluminum oxide, barium titanate and the like, and polymers such as tetrafluoroethylene, polyvinylidene fluoride and the like may be used alone or in combination thereof. However, the particles are not particularly limited thereto.

The layer thickness of the protective overcoat layer is from about 0.1 μm to about 500 μm, or from about 1 μm to about 50 μm.

There may be present a conductive filler in any one of the substrate layers, intermediate layers or overcoat layers. Fillers include those listed previously as electroconductive agents and particles and carbon fillers such as carbon black, graphite, fluorinated carbon, and the like; conductive polymer fillers such as polyaniline, polypyrrole, polythiophene, polyacetylene and the like; metal fillers such as silver, copper, antimony and the like; metal oxide fillers such as titanium oxides, zinc oxides antimony tin oxides and the like.

The protective overcoat 7 also allows for refurbishing of the BCR 2. By applying a protective overcoat 7 to a BCR 2 having a damaged surface, either the base material 5 or the outer surface, a BCR can be used multiple times. When the outer surface of the BCR 2 becomes too damaged to provide acceptable prints, it is returned for refurbishing. Refurbishing involves applying a protective overcoat 7 as described herein.

A dispersion of an aminoplast resin, one of a polyol resin or a nylon resin, and a conductive additive is prepared by ball milling the aminoplast resin and one of the polyol resin or nylon resin in a solvent such a methanol or methyl ethyl ketone with the conductive material. This process can take several days. A catalyst is added to the dispersion to lower the curing temperature and is optional. The catalyst is preferably a blocked or un-blocked p-toluene sulfonic acid at a loading of from about 0.01 to about 5, or from about 0.25 to about 1.5 weight percent based on the total weight of the protective overcoat. The dispersion is then coated on the BCR 2. The coating is cured at a temperature of about 25 to about 160° C., or from about 100 to about 135° C., for about 20 to about 40 minutes, or from about 25 to 35 minutes. Typical coating techniques include dip coating, roll coating, spray coating, rotary atomizers, ring coating, die casting, flow coating and the like.

Since BCRs usually can last in machine for many thousand cycles, accelerated testing was performed with a print cartridge wear test fixture. The protocol for the testing involves initial screening (time=0), which involves resistance and charge uniformity measurements, and print test. The BCR was subjected to wear for 50,000 cycles in the wear fixture, followed by a screening under the same procedures as the time=0 screening. The same process continued, i.e. screening at successive 50 thousand intervals in the wear fixture, until significant print streaks appeared.

EXAMPLE 1

The overcoat was formulated as polyol (AT-410, Rohm & Haas) and melamine (Cymel 323, Cytec Corp.) as base resins. The resins crosslink under thermal activation and a catalyst was used to lower curing temperature. The catalyst was Nancure XP357 or Cycat 4040; both are p-toluene sulfonic acids where the former is blocked. For conductivity, carbon blacks, in particular CONDUCTEX® carbon black, available from Columbian Chemicals, were used.

Overcoat dispersions were prepared by ball milling the carbon black with the resins in methyl ethyl ketone overnight to several days. Ratios between the polyol (AT-410 Rohm & Haas) and melamine (Cymel 323 by Cytec Corp) were varied from about 25/75 to 75/25 and similar film forming properties were found for the ranges studied when coated on polyethylene terephthalate (PET) substrate. The carbon black loading was about 6-7% by weight based on the total weight of total solids to achieve a surface resistivity of about $1\times10^5$ to about $1\times10^6$ ohm/. Acid catalysts including Cytec 4040 or Nacure XP357 were also included in the formulations, with loading of 0.25-1.5% by weight based on the total weight of total solids. Coatings were done using dip coating and the overcoats were cured at 120-140° C. for about 20-40 minutes. Care was taken in handling the BCRs, touching of the edges of the rollers during coating and curing was avoided. Some coating streaks and patterns were present due to the nature of the dip coating.

Charge uniformity measurements of BCRs with the protective overcoat of polyol and melamine and 4-9% of carbon blacks and regular BCRs with no overcoat at time=0 and after 50,000 run in wear fixture were compared. The charge uniformity of overcoated BCRs is comparable to the standard BCR without any overcoats before and after the wear test, suggesting there is no internal electric build-up in the overcoat layers and no deterioration in the charging capability with the addition of the overcoat.

Start and running torques of the overcoated BCRs were comparable with standard BCR and the results are consistent with print and wear test, as no noticeable torque issues were detected.

Figure 2:
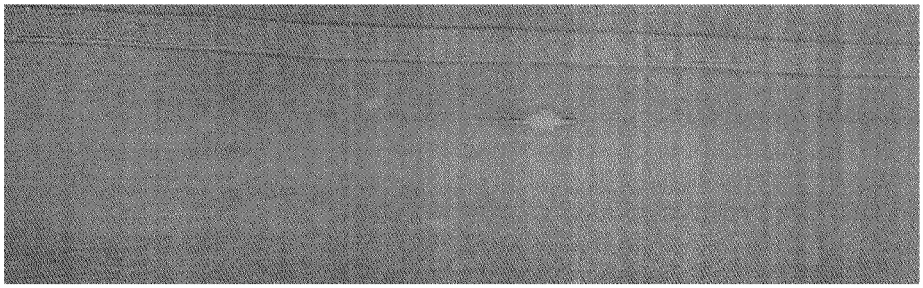
FIG. 2 shows a scanned image print output from a BCR having an outer surface layer in accordance with an aspect herein.
Figure 3:
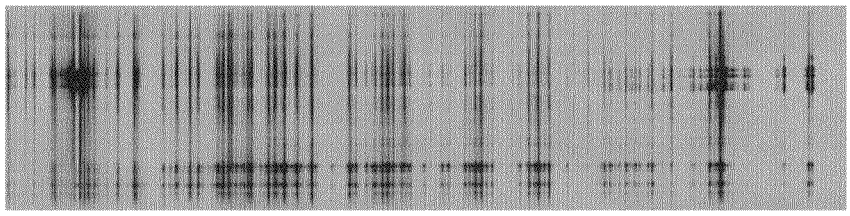
FIG. 3 shows a scanned image print output of a standard BCR.

The print tests are shown in FIGS. 2 and 3. In particular, the overcoat has a composition of AT-410/Cymel323/SC9773/Nacure XP357=46/46/7/1 in weight. After 50,000 cycles run in wear fixture, the overcoated BCR was print tested, and other than some minor lateral streaks (perpendicular to the print direction) which are attributed to coating defects and were also present at time=0, FIG. 2 shows that print outputs were generally fine. FIG. 2 shows a coating streak on the BCR surface. In contrast, a control BCR without an overcoat showed a significant number of print streaks along the print direction, suggesting several damages to the surface. This is shown in FIG. 3. The number of streaks amounts to several dozens and concentrates in the middle ⅔ of the BCR. At time=0 the control BCR did not show any discernable print defects. However, as mentioned above, there were similar lateral coating streaks visible for the overcoated BCR, but the streaks did not deteriorate after the 50,000 run.

EXAMPLE 2

The overcoat was formulated using melamine (Cymel 323, Cytec Corp.) and nylon (Elvamid 8061, Dupont) as the base resins. The resins crosslink under thermal activation and a catalyst can be used to lower curing temperature. The catalyst used was Nancure XP357 or Cycat 4040, as described in Example 1. For conductivity, carbon blacks, in particular CONDUCTEX® carbon black, available from Columbian Chemicals, were used. Typical overcoat dispersions were prepared by ball milling the carbon black with Cymel 323 and Elvamid 8061 in methanol for overnight to several days. Preliminary studies involved activities like varying the ratio between the two base resins to check curing and film forming properties, determining the range of carbon black loading and the appropriate amount of catalyst. Ratios between the melamine (Cymel 323 by Cytec Corp) and nylon (Elvamid 8061 by Dupont) were varied from about 30/70 to 5/95 and similar film forming properties were found when coated on PET substrate. However, when coated on BCRs, higher nylon contents would induce some wrinkles. The carbon black loading was about 6.5-6.75% by weight based on the total weight of total solids to achieve a surface resistivity of ~$1\times10^5$-$1\times10^6$ ohm/. Acid catalysts like Cytec 4040 or Nacure XP357 were also included in the formulations, with loading of 0.25-1.5% by weight based on the total weight of total solids. Coatings were done using Tsukiage coating and the overcoats were cured at 120-140° C. for about 20-40 minutes.

Charge uniformity measurements of overcoated BCRs containing melamine and nylon and 5-8% of carbon blacks and regular (no overcoat) BCRs at time=0 and after 50,000 run in Hodaka wear fixture were taken. The charge uniformity of overcoated BCRs was comparable to the standard BCR without any overcoats before and after the wear test, suggesting there is no internal electric build-up in the overcoat layers and no deterioration in the charging capability. Start and running torques of typical overcoated BCRs are also comparable with the standard BCR and the results are consistent with print and wear test, as no noticeable torque issues were detected.

Figure 4:
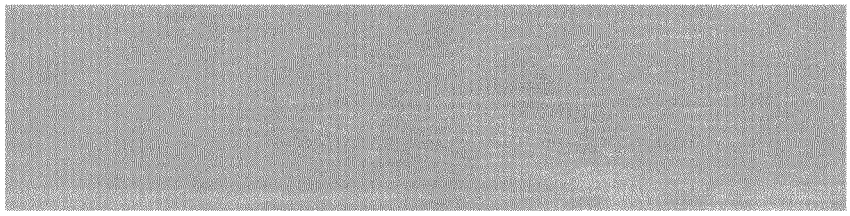
FIG. 4 shows a scanned image print output from a BCR having an outer surface layer in accordance with an aspect herein.

In particular, the overcoat has a composition of Cymel323/Elvamid8061/SC9773/Nacure XP357=88/5/6.5/0.5 in weight. After 50,000 cycles run in the Hodaka wear fixture, the overcoated BCR was tested in a Pinehurst machine and other than some minor lateral streaks (perpendicular to the print direction) attributed to coating defects and present at time=0, print outputs were generally fine (see FIG. 4). In contrast, the control BCR without an overcoat showed a significant number of print streaks along the print direction, suggesting several damaged areas to the surface (FIG. 3). The number of streaks amounts to several dozens and concentrates in the middle two-thirds of the BCR. At time=0, the control BCR did not show any discernable print defects. In summary, a protective overcoat based on melamine and nylon or melamine and polyol for a bias charge roller shows substantial improvement in life extension. The overcoated BCR shows similar performance characteristics but a significantly better resistance to surface damages than that of standard BCRs without any overcoats.

It will be appreciated that a variety of the above-disclosed and other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

We claim:

1. A bias charging member comprising:

a) a conductive core, b) a base material provided on the conductive core wherein the base material is selected from the group consisting of isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber, acrylonitrile-butadiene copolymer rubber (NBR) and natural rubber, and c) an outer surface layer provided on the base material, the outer surface comprising a resin of melamine and a polyol, p-toluene sulfonic acid of from about 0.1 weight percent to about 5 percent by weight based on a total solids weight of the outer surface layer and a conductive additive comprising carbon black, wherein the melamine and polyol comprise a weight ratio of from about 25/75 to about 75/25.

2. The bias charging member in accordance with claim 1, further comprising a second-conductive additive selected from the group consisting of aluminum, copper, nickel and stainless steel, tin oxide, indium oxide, titanium oxide, tetraethylammonium perchlorate, tetraethylammonium tetraethylammonium chlorate, lauryltrimethyl ammonium perchlorate, lauryltrimethyl ammonium chlorate perchlorates, lithium chlorate lithium perchlorate, poly anline, polypyrrole, polythiophene, polyacetylene, magnesium chlorate and magnesium perchlorate.

3. The bias charging member in accordance with claim 1, wherein the carbon black comprises an amount from about 0.1 to about 40 percent by weight based on the weight of total solids.

4. A method of refurbishing a bias charging member comprising:

obtaining a bias charging member having a conductive core, a base material provided on the conductive core wherein the base material is selected from the group consisting of isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber, acrylonitrile-butadiene copolymer rubber (NBR) and natural rubber;

coating a dispersion of a melamine resin, a polyol resin, a conductive additive comprising carbon black and p-toluene sulfonic acid at about 0.1 weight percent to about 5 percent by weight based on a total solids weight of the dispersion on the base material, wherein the coating is selected from the group consisting of dip coating, roll coating, spray coating, rotary atomizers, ring coating, die casting and flow coating; and curing the coating to form a conductive overcoat.

5. A method of claim 4, wherein the curing comprises heating the coating at a temperature of about 120 to about 140° C. for a time of about 20 to about 40 minutes.

6. The method of claim 4, wherein the melamine and polyol comprise a weight ratio of from about 25/75 to about 75/25.

7. The method of claim 4, wherein the conductive overcoat has a surface resistivity of from about $1\times10^5$ ohm/square to about $1\times10^6$ ohm/square.

8. The method of claim 4, further comprising preparing the dispersion by ball milling the melamine resin, the polyol resin, p-toluene sulfonic acid and the carbon black in methanol or methyl ethyl ketone.

9. A bias charging member comprising:

a) a conductive core, b) a base material provided on the conductive core wherein the base material is selected from the group consisting of isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber, acrylonitrile-butadiene copolymer rubber (NBR) and natural rubber, and c) an outer surface layer provided on the base material and comprising a resin of melamine and polyol, carbon black and p-toluene sulfonic acid, wherein the outer surface layer has a surface resistivity of from about $1\times10^1$ ohm/square to about $1\times10^{12}$ ohm/square.

10. The bias charging member in accordance with claim 9, wherein the outer surface layer comprises a thickness of from about 0.1 μm to about 500 μm.

* * * * *